US008522495B2

(12) United States Patent
Peeters

(10) Patent No.: US 8,522,495 B2
(45) Date of Patent: Sep. 3, 2013

(54) HANDRAIL CONSTRUCTION

(75) Inventor: Johannes Hendricus Alphonsus Peeters, Rotterdam (NL)

(73) Assignee: FiberCore IP B.V., Rotterdam (NL)

( * ) Notice: Subject to any disclaimer, the term of this patent is extended or adjusted under 35 U.S.C. 154(b) by 0 days.

(21) Appl. No.: 13/144,148

(22) PCT Filed: Jan. 12, 2010

(86) PCT No.: PCT/NL2010/050012

§ 371 (c)(1),
(2), (4) Date: Aug. 1, 2011

(87) PCT Pub. No.: WO2010/080034

PCT Pub. Date: Jul. 15, 2010

(65) Prior Publication Data

US 2011/0277403 A1 Nov. 17, 2011

(30) Foreign Application Priority Data

Jan. 12, 2009 (NL) ..... 2002410

(51) Int. Cl.
*E04F 11/18* (2006.01)

(52) U.S. Cl.
USPC ..... 52/184; 256/65.16

(58) Field of Classification Search
USPC ..... 52/182–184; 256/59, 64, 65.01, 256/66–69, 65.02, DIG. 6, 65.15, 65.16 X; 403/6–9, 179, 230, 233, 260, 292, 344–347, 403/353, 359.4; 138/98, 106
See application file for complete search history.

(56) References Cited

U.S. PATENT DOCUMENTS

| | | | | | |
|---|---|---|---|---|---|
| 2,150,651 | A | * | 3/1939 | Ewing | 403/201 |
| 3,787,033 | A | * | 1/1974 | Snyder et al. | 256/59 |
| 3,859,409 | A | * | 1/1975 | Coonrod | 264/295 |
| 4,053,140 | A | * | 10/1977 | Clemens et al. | 256/19 |
| 4,072,294 | A | | 2/1978 | Densen | |
| 4,477,059 | A | * | 10/1984 | Willis | 256/65.11 |
| 4,498,660 | A | * | 2/1985 | Brema et al. | 256/19 |
| 4,930,754 | A | * | 6/1990 | Caron et al. | 256/65.05 |
| 5,303,900 | A | | 4/1994 | Zulick, III et al. | |
| 5,370,368 | A | | 12/1994 | Terrels et al. | |
| 5,755,981 | A | * | 5/1998 | Payne | 249/24 |
| 6,019,136 | A | * | 2/2000 | Walsh et al. | 138/98 |

(Continued)

FOREIGN PATENT DOCUMENTS

| | | | |
|---|---|---|---|
| CH | 375389 | A | 2/1964 |
| DE | 1925 144 | A1 | 11/1970 |

(Continued)

OTHER PUBLICATIONS

International Search Report, dated Jun. 15, 2010, from corresponding PCT application.

*Primary Examiner* — Brian Glessner
*Assistant Examiner* — Beth Stephan
(74) *Attorney, Agent, or Firm* — Young & Thompson

(57) ABSTRACT

A handrail construction, such as for a bridge or stairway, includes a tubular handrail element, the cross section of which is defined by a closed tube wall which encloses an internal cavity, and also a series of supports fastened to the handrail element. At least one counterpiece is located in the interior of the handrail element. Each support is fastened to a counterpiece via a fastening element which protrudes through the tube wall of the handrail element. The handrail element includes a thermosetting material.

15 Claims, 4 Drawing Sheets

(56) References Cited

U.S. PATENT DOCUMENTS

| | | | | |
|---|---|---|---|---|
| 6,601,245 | B2 * | 8/2003 | Weiss | 4/496 |
| 6,935,623 | B2 * | 8/2005 | Cook et al. | 256/65.08 |
| 2003/0066567 | A1 * | 4/2003 | Manners | 138/98 |
| 2003/0066996 | A1 * | 4/2003 | Cook et al. | 256/65.15 |

FOREIGN PATENT DOCUMENTS

| | | | |
|---|---|---|---|
| FR | 2 521 610 | A1 | 8/1983 |
| NL | 7504978 | A | 11/1975 |
| WO | 02/072975 | A1 | 9/2002 |

* cited by examiner

HANDRAIL CONSTRUCTION

The invention relates to a handrail construction, such as for a bridge or stairway, comprising a tubular handrail element, the cross section of which is defined by a closed tube wall which encloses an internal cavity, and also a series of supports fastened to the handrail element, at least one counterpiece being located in the interior of the handrail element and each support being fastened to a counterpiece by means of a fastening element which protrudes through the tube wall of the handrail element.

A handrail construction of this type is known from U.S. Pat. No. 5,370,368. This known handrail construction uses a plastic tube located at the top end of the supports. In connection with the sturdiness of the handrail construction, a metal pipe is attached in said top plastic tube over the entire length thereof. This ensures that the handrail construction is sufficiently safe for the public. Furthermore, this known handrail construction has supplementary plastic tubes extending at a lower level of the supports. Less stringent requirements are placed on these plastic tubes, so that no fully continuous metal pipe is attached therein.

In fact, this known handrail construction is a metal pipe at the top end of the supports, which metal pipe is covered with a plastic casing. However, a handrail construction of this type is relatively expensive and complex. The object of the invention is therefore to provide a handrail construction which also offers the desired safety for the public, but which can nevertheless be embodied in a less costly and more durable manner. That object is achieved in that the handrail element comprises a thermosetting material.

Making the handrail element of the handrail construction from a thermosetting material makes the handrail element appropriately strong and rigid. It is therefore not necessary to attach a metal pipe over the entire length of the handrail element, allowing the construction and costs of this handrail construction to be limited. It is necessary to provide the plastics material of the handrail element with counterpieces merely at certain locations, at the level of the supports. Nevertheless, it is of course possible for the counterpiece to extend over substantially the entire length of the handrail element. In that case, the combined mechanical properties of the handrail element made of thermosetting material and the counterpiece extending therein over the entire length yield a very sturdy construction.

According to a preferred embodiment, a series of counterpieces is provided that are located set apart from one another and the position of which corresponds to that of a support. In connection with the correct positioning of the counterpieces from this series, which must after all each come to be positioned opposite a support, various techniques can be used. According to a first possibility, neighbouring counterpieces can for this purpose be connected to one another by a pull member, such as a cord. In this embodiment, the counterpieces can be received one by one in the handrail element, ensuring that, at the opposing end of the handrail element, a pull-cord extends to outside that handrail element.

Subsequently, all the counterpieces can be pulled to the correct position in the handrail element by pulling on the cord. Since the mutual distance of the counterpieces is fixed, it is possible to establish on the basis of the position of the cord whether the counterpieces are in the correct position, i.e. each opposite a support. However, this does not always require the use of a pull member; according to an alternative embodiment, the neighbouring counterpieces can in that connection enclose between them a push member. In that case, the counterpieces can be pushed inward in the handrail element.

The counterpieces themselves can be embodied in various ways, for example as hollow counterpieces. Alternatively, they can be solid in their embodiment. Furthermore, the counterpieces can comprise thermoplastic material, thus facilitating for example the fastening of the handrail element to the supports by means of screws such as wood screws. Other materials which are suitable for attaching a screw therein are for example rubber, preserved wood, cork and the like. Furthermore, the handrail element can comprise a fibre reinforcement, the fibres being directed predominantly in the longitudinal direction of the handrail element.

The handrail construction according to the invention can be used in various ways. In that connection, the invention therefore also relates to a bridge construction, comprising a bridge girder and also a handrail construction extending on a longitudinal side of the bridge girder. As described hereinbefore, the supports are in this case fastened to the bridge girder. According to a further possibility, the invention relates to a stairway construction, comprising a series of steps and also a handrail construction extending on at least one longitudinal side of the series of steps, wherein the supports are fastened to the series of steps. In addition, the handrail construction can also comprise brackets, for example, for fastening to a wall.

The handrail construction according to the invention can be used for all kinds of purposes, as described hereinbefore, but also for a balcony or gallery, for example. A defined finish, such as a pattern which simulates wood, can be applied to the thermosetting material of the handrail element. Copper or stainless steel effects are also possible. All this can for example be finished with a transparent lacquer coating which can subsequently be finished with a polyurethane layer in order to ensure the desired impact and scratch resistance.

The cross-sectional shape of the handrail element can be selected in any desired manner, so as to be round or square, for example, but in all cases the cross section will be closed all the way round in order to ensure the desired strength and rigidity. The advantage of the construction described hereinbefore is that the construction is to a large extent maintenance-free. In addition, the construction is for the most part impervious to graffiti.

The invention will be described hereinafter in greater detail based on a few exemplary embodiments illustrated in the figures, in which.

Figure 1:
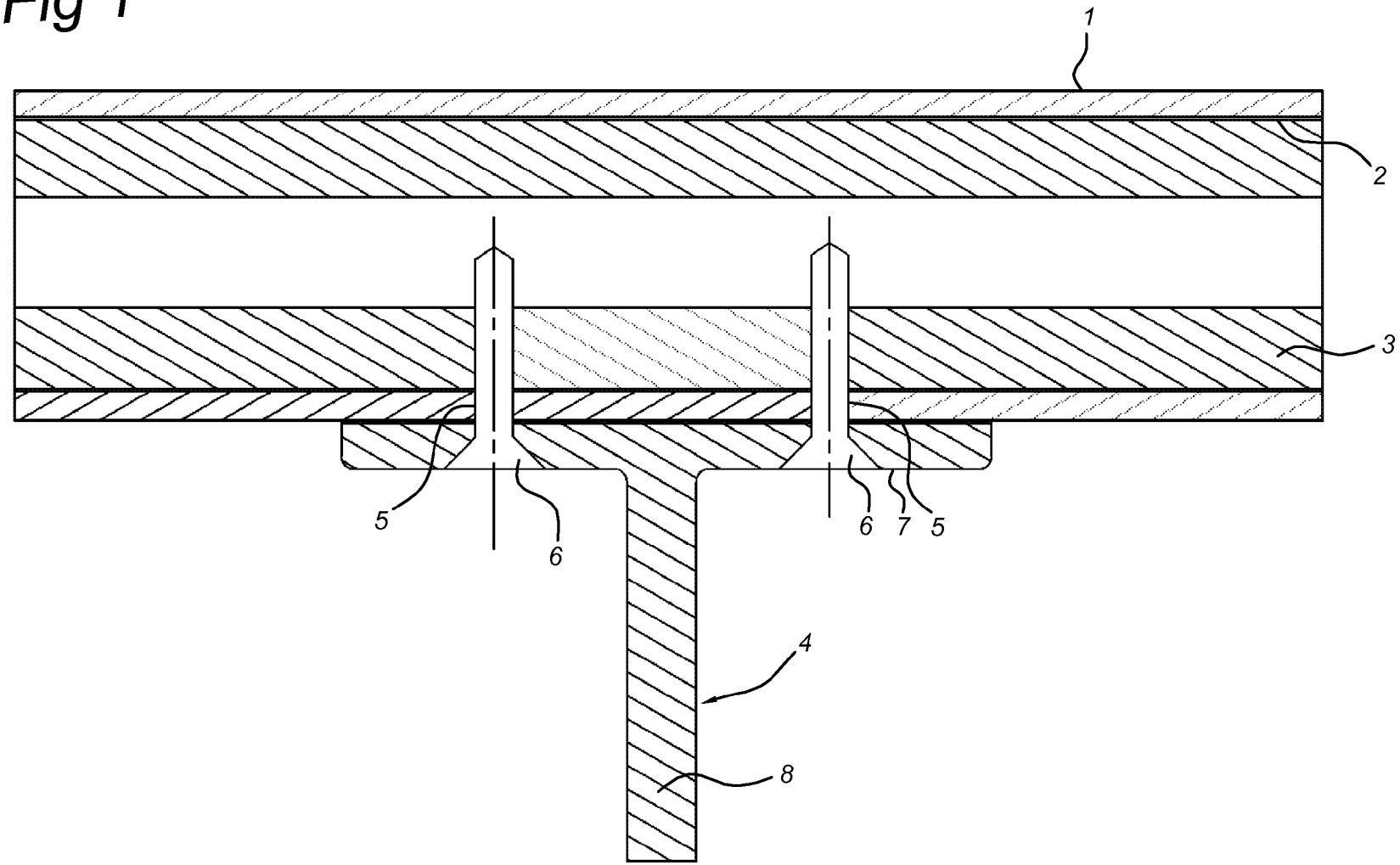
FIG. 1 is a longitudinal section through a first variant of the handrail construction according to the invention.

The handrail construction represented in FIG. 1 consists of the tubular handrail element 1 having for example a circular cross section. The tubular handrail element 1 defines an internal cavity 2 in which the counterpiece 3 extends. The handrail element 1 is made of a thermosetting material which has the required strength and rigidity so that the public can be effectively protected by the handrail construction. However, a brittle material of this type is difficult to fasten to the supports which are denoted in their entirety by 4.

In connection to the fastening of the supports 4 to the handrail element 1, holes 5, through which the screws 6 extend, are formed in that handrail element 1. The head of these screws rests against the flange 7 of the support 4 which also consists of the leg 8.

The screws 6 are screwed in the counterpiece 3, forming screw thread. This counterpiece 3 can for this purpose be made, for example, of an (optionally recycled) thermoplastic material. The counterpieces 3 can be received loose in the handrail element. It is however also possible to secure the counterpieces in the handrail element, for example by means of glue.

Figure 2:
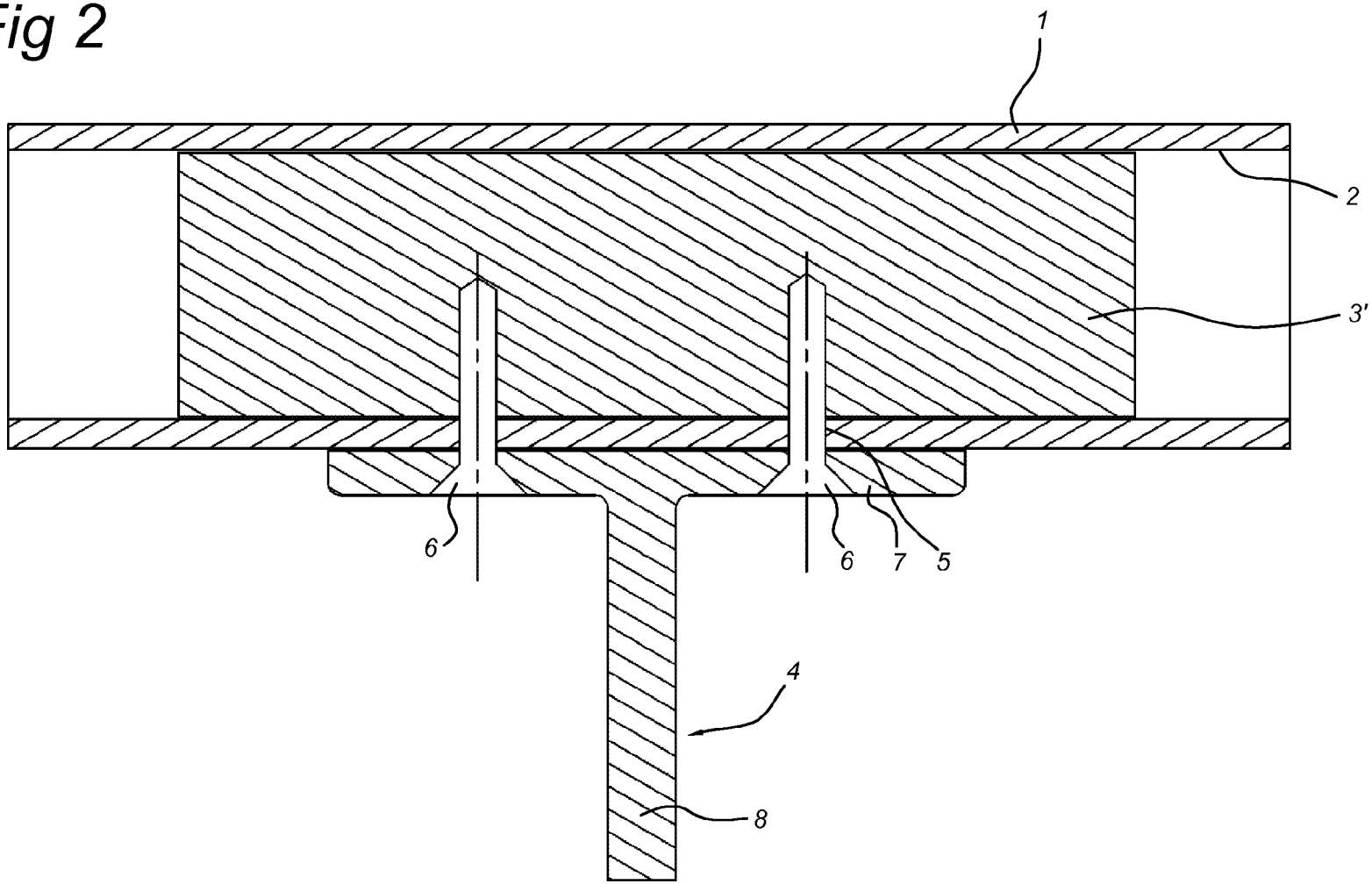
FIG. 2 shows a second variant.

The counterpiece 3 shown in FIG. 1 is hollow. However, as shown in FIG. 2, the counterpiece 3' can also be solid. In addition, the counterpiece does not have to extend over the entire length of the handrail element 1. In this case too, it is possible to form, by making the counterpiece 3' of thermoplastic material, in each case a screw hole in that counterpiece 3' when screwing-in the screws 6. It is necessary to form beforehand the holes 5 in the handrail element 1 made of thermosetting material.

Figure 3:
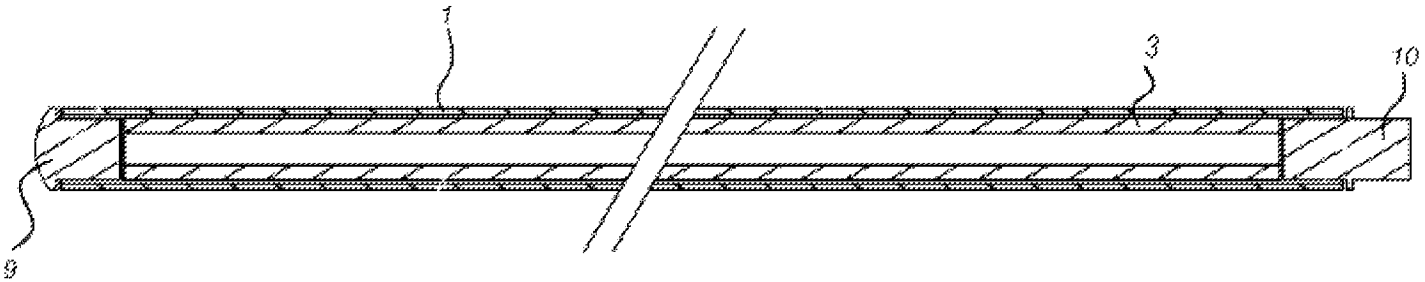
FIG. 3 shows a complete tube element according to a first variant.

FIG. 3 shows a piece of handrail with the handrail element 1, over almost the entire length of which the hollow tubular counterpiece 2 extends, as shown in FIG. 1. What is known as the end stop 9 is attached to one end of the handrail element 1; the coupling part 10, by means of which a further piece of handrail can be coupled-on, is attached to the other end. The presence of the tubular counterpiece 2 over the entire length of the handrail element 1 allows a support 4 to be fastened thereto at any desired site.

Figure 4:
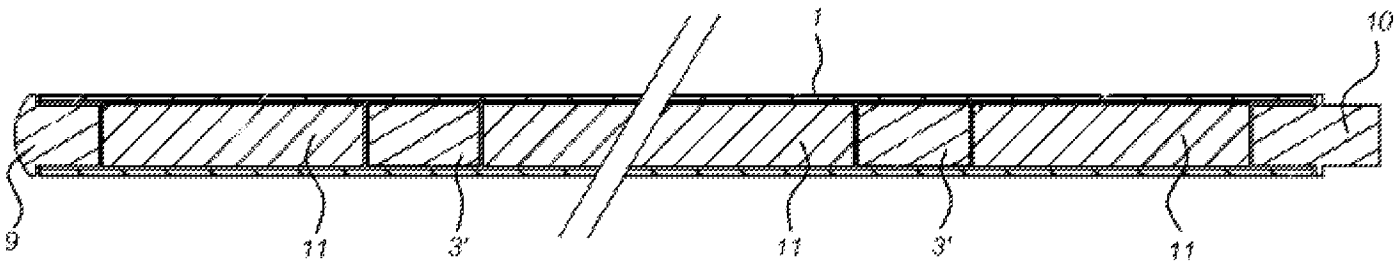
FIG. 4 shows a second variant of a complete tube element.

The variant of FIG. 4 shows a piece of handrail consisting of the handrail element 1 and a number of counterpieces 3' as shown in FIG. 2. The distance pieces 11 extend between these counterpieces 3'. The length of these distance pieces 11 is selected in such a way that, in combination with the length of the counterpieces 3', these counterpieces 3' each come to be positioned opposite a support 4 to which the piece of handrail has to be fastened. These components can be attached in the handrail element 1 by successively receiving the components therein and subsequently pushing forward through the following elements. An end stop 9 and a coupling part 10 are provided in this case too.

Figure 5:
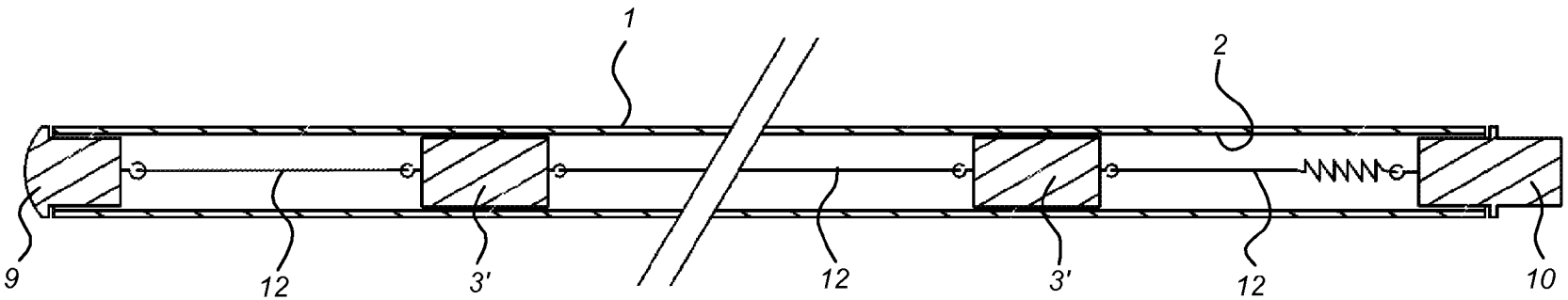
FIG. 5 shows a third variant of a complete tube element.

The variant of FIG. 5 corresponds broadly to that of FIG. 4, with the difference that, instead of distance pieces 11, pull members 12 now form the coupling between the counterpieces 3'. These counterpieces 3' can thus be successively pulled in the handrail element 1. In addition, a series of this type also contains the end stop 9 and the coupling part 10.

List of Reference Numerals

1. Handrail element
2. Cavity in handrail element
3, 3'. Counterpiece
4. Support
5. Hole in handrail element
6. Screw
7. Flange of support
8. Leg of support
9. End stop
10. Coupling part
11. Distance piece
12. Pull member

The invention claimed is:

1. A handrail construction configured for use with a bridge or stairway, the handrail construction comprising:

a tubular handrail element having a cross section defined by a closed tube wall which encloses an internal cavity, the tubular handrail element comprising a thermosetting material; and a plurality of spaced supports fastened to an external surface of the handrail element, at least two counterpieces each being located in the internal cavity of the handrail element, each support being fastened to one of the counterpieces by at least one fastening element which protrudes through the tube wall of the handrail element and into one of the counterpieces, the counterpieces being provided such that each of the counterpieces is set apart from other counterpieces, the position of the counterpieces each corresponding to one of the supports, adjacent counterpieces being connected to one another by one of a pull member and a push member, wherein the at least one fastening element comprises at least one screw, the at least one screw being screwed in to one of the counterpieces.

2. The handrail construction according to claim 1, wherein the counterpieces extend over substantially the entire length of the handrail element.

3. The handrail construction according to claim 1, wherein the one of the pull member and the pull member spaces the adjacent counterpieces with respect to each other to position each of the counterpieces within the handrail element having a fixed distance therebetween in order to align each of the counterpieces opposite one of the supports.

4. The handrail construction according to claim 1, wherein the counterpieces are connected by the pull member, and the pull member is a cord.

5. A bridge construction, comprising:

a bridge girder; and the handrail construction according to claim 1 extending on a longitudinal side of the bridge girder, wherein the supports are fastened to the bridge girder.

6. The handrail construction according to claim 1, wherein each of the counterpieces is hollow.

7. The handrail construction according to claim 1, wherein each of the counterpieces is solid.

8. The handrail construction according to claim 1, wherein each of the counterpieces comprises a thermoplastic material.

9. The handrail construction according to claim 1, wherein the screws such as are wood screws.

10. The handrail construction according to claim 1, wherein the handrail element comprises a fiber reinforcement having fibers, the fibers being directed in the longitudinal direction of the handrail element.

11. The handrail construction according to claim 1, wherein the external surface of the handrail element is provided with one or more of a pattern and a color effect.

12. A stairway construction, comprising:

a series of steps; and the handrail construction according to claim 1 extending on at least one longitudinal side of the series of steps, wherein the supports are fastened to the series of steps.

13. The handrail construction according to claim 1, wherein the adjacent counterpieces are connected to one another by the push member.

14. The handrail construction according to claim 11, wherein the external surface is provided with the pattern, the pattern being a wood print.

15. The handrail construction according to claim 11, wherein the external surface is provided with the color effect, the color effect being one or more of copper and stainless steel.

* * * * *